US009677710B2

(12) United States Patent
Bougault et al.

(10) Patent No.: US 9,677,710 B2
(45) Date of Patent: Jun. 13, 2017

(54) CORNER STRUCTURE OF A SEALED AND THERMALLY INSULATING TANK FOR STORING A FLUID

(71) Applicant: Gaztransport Et Technigaz, Saint Remy-les-Chevreuse (FR)

(72) Inventors: Johan Bougault, Jouy-en-Josas (FR); Sebastien Durand, Boullay (FR)

(73) Assignee: Gaztransport ET Technigaz, Saint Remy les Chevreuse (FR)

( * ) Notice: Subject to any disclaimer, the term of this patent is extended or adjusted under 35 U.S.C. 154(b) by 63 days.

(21) Appl. No.: 14/783,768

(22) PCT Filed: Apr. 3, 2014

(86) PCT No.: PCT/FR2014/050793

§ 371 (c)(1),
(2) Date: Oct. 9, 2015

(87) PCT Pub. No.: WO2014/167214

PCT Pub. Date: Oct. 16, 2014

(65) Prior Publication Data

US 2016/0252210 A1 Sep. 1, 2016

(30) Foreign Application Priority Data

Apr. 12, 2013 (FR) ..... 13 53322

(51) Int. Cl.
*F17C 3/02* (2006.01)
*B63B 25/16* (2006.01)
(Continued)

(52) U.S. Cl.
CPC ..... *F17C 3/027* (2013.01); *B63B 25/16* (2013.01); *B63B 27/25* (2013.01);
(Continued)

(58) Field of Classification Search
CPC ..... F17C 3/027; F17C 2201/0157; F17C 2201/052; F17C 2203/0631;
(Continued)

(56) References Cited

U.S. PATENT DOCUMENTS 4,065,019 A 12/1977 Letourneur et al.
5,501,359 A 3/1996 Chauvin et al.
(Continued)

FOREIGN PATENT DOCUMENTS

FR 2321657 A1 3/1977
FR 2691520 A1 11/1993
(Continued)

OTHER PUBLICATIONS

International Search Report and Written Opinion, PCT Application No. PCT/FR2014/050793; dated Sep. 16, 2014, 12 pages.

*Primary Examiner* — Nicolas A Arnett

(57) ABSTRACT

The disclosure relates to a corner structure which is suitable for a sealed and thermally insulating tank for storing a fluid comprising a secondary thermal insulation barrier which is retained on a carrier structure, a secondary sealing membrane, a primary thermal insulation barrier and a primary sealing membrane which is intended to be in contact with the fluid contained in the tank, the corner structure comprising: a first panel and a second panel forming a corner of the secondary thermal insulation barrier, and comprising an external face intended to move opposite the carrier structure and an internal face; a corner arrangement of the secondary sealing membrane, which arrangement is fixed to the first and second panels; a first insulating block and a second insulating block of a primary thermal insulation barrier which are fixed to the first and second panels, respectively, and which rest against the corner arrangement of the secondary sealing membrane; and a corner of a primary sealing barrier comprising a first wing and a second wing which are fixed to the first and second insulating blocks, respectively.

18 Claims, 9 Drawing Sheets

(51) Int. Cl.
*B63B 27/24* (2006.01)
*B63B 27/25* (2006.01)

(52) U.S. Cl.
CPC *F17C 2201/0157* (2013.01); *F17C 2201/052* (2013.01); *F17C 2203/0333* (2013.01); *F17C 2203/0354* (2013.01); *F17C 2203/0358* (2013.01); *F17C 2203/0631* (2013.01); *F17C 2209/221* (2013.01); *F17C 2209/228* (2013.01); *F17C 2221/033* (2013.01); *F17C 2223/0161* (2013.01); *F17C 2223/033* (2013.01); *F17C 2260/011* (2013.01); *F17C 2260/013* (2013.01); *F17C 2270/0107* (2013.01); *F17C 2270/0121* (2013.01); *F17C 2270/0136* (2013.01)

(58) Field of Classification Search
CPC ..... F17C 2203/0333; F17C 2203/0354; F17C 2221/033; F17C 2260/011; F17C 2260/013; F17C 2270/0107; F17C 2270/0136; F17C 2270/0121; F17C 2223/0161; F17C 2223/033; F17C 2209/221; F17C 2209/228; B63B 27/25; B63B 25/16
USPC ..... 220/560.04, 560.08, 560.11, 560.12; 137/236.1; 141/1, 82, 231
See application file for complete search history.

(56) References Cited

U.S. PATENT DOCUMENTS 6,374,761 B1 * 4/2002 Dhellemmes ..... B63B 3/68 114/74 A
7,171,916 B2 * 2/2007 Yang ..... B63B 3/68 114/74 A
7,204,195 B2 * 4/2007 Yang ..... B63B 25/14 114/74 A
7,325,288 B2 * 2/2008 Yang ..... B63B 3/68 220/560.07
7,597,212 B2 * 10/2009 Yang ..... B63B 3/68 220/560.06
7,717,288 B2 * 5/2010 Yang ..... B63B 3/68 220/560.05
7,900,794 B2 * 3/2011 Dhellemmes ..... B63B 25/16 114/74 A
2006/0096209 A1 * 5/2006 Dhellemmes ..... B63B 3/68 52/405.3
2006/0096235 A1 * 5/2006 Dhellemmes ..... B63B 25/16 204/267
2006/0117566 A1 6/2006 Yang et al.
2006/0118018 A1 * 6/2006 Yang ..... B63B 3/68 114/74 A
2006/0118019 A1 * 6/2006 Yang ..... B63B 3/68 114/74 A
2006/0131304 A1 * 6/2006 Yang ..... B63B 3/68 220/4.16
2007/0028823 A1 * 2/2007 Yang ..... B63B 25/14 114/74 A
2010/0288778 A1 * 11/2010 Dhellemmes ..... B63B 25/16 220/592.26
2016/0076701 A1 * 3/2016 Philippe ..... F17C 3/027 114/256

FOREIGN PATENT DOCUMENTS

WO 2006003192 A1 1/2006
WO 2007052961 A1 5/2007
WO 2014167214 A2 10/2014
WO 2014167214 A3 10/2014

* cited by examiner

CORNER STRUCTURE OF A SEALED AND THERMALLY INSULATING TANK FOR STORING A FLUID

CROSS-REFERENCE TO RELATED APPLICATION

This application is the National Stage of, and therefore claims the benefit of, International Application No. PCT/FR2014/050793 filed on Apr. 3, 2014, entitled "CORNER STRUCTURE OF A SEALED AND THERMALLY INSULATING TANK FOR STORING A FLUID," which was published in French under International Publication Number WO 2014/167214 on Oct. 16, 2014. International Application No. PCT/FR2014/050793 claims priority to FR Application No. 1353322 filed on Apr. 12, 2013. Both of the above applications are commonly assigned with this National Stage application and are incorporated herein by reference in their entirety.

TECHNICAL FIELD

The disclosure relates to the field of sealed and thermally insulating tanks having membranes for storing and/or transporting a fluid, such as a cryogenic fluid.

The disclosure more particularly relates to a corner structure of such a sealed and thermally insulating tank.

BACKGROUND

Document FR 2 691 520 describes a sealed and thermally insulating tank successively having, in the direction of the thickness, from the inner side to the outer side of the tank, a primary sealing membrane, in contact with the fluid contained in the tank, a primary thermal insulation barrier, a secondary sealing membrane, a secondary thermal insulation barrier and a carrier structure which is constituted by metal sheets which form the hull or the double hull of a merchant tanker, such as a methane tanker.

The corner zones of the tank are produced from preassembled corner structures, in the form of a dihedron, which are illustrated in FIG. 3 of the document FR 2 691 520. Such a preassembled corner structure comprises two beveled insulating plates which form the secondary thermal insulation barrier, a flexible membrane resting on the insulating plates of the secondary thermal insulation barrier and constituting the secondary sealing barrier, a plurality of insulating blocks of the primary thermal insulation barrier which are adhesively bonded to the secondary sealing membrane and metal corners of a primary sealing membrane which are fixed to the insulating blocks of the primary thermal insulation barrier.

The adhesive bonding of the insulating blocks of the primary thermal insulation barrier to the secondary sealing barrier is not completely satisfactory. In particular, the bonding operations of the insulating blocks are complex to carry out.

Given this complexity, the adhesive bonding of the insulating blocks of the primary thermal insulation barrier to the secondary sealing membrane is brought about in the workshop and the corner structures are integrally preassembled. However, such preassembled corner structures are heavy, making the transport and handling thereof to and at the installation site of the tank difficult.

SUMMARY

A notion on which the disclosure is based is to propose a corner structure which is easy to assemble.

According to an embodiment, the disclosure provides for a sealed and thermally insulating tank for storing a fluid comprising a secondary thermal insulation barrier which is retained on a carrier structure, a secondary sealing membrane, a primary thermal insulation barrier and a primary sealing membrane which is intended to be in contact with the fluid contained in the tank, the tank comprising a corner structure comprising:

a first panel and a second panel forming a corner of the secondary thermal insulation barrier and comprising an external face opposite the carrier structure and an internal face;

a corner arrangement of the secondary sealing membrane, which arrangement is fixed to the first and second panels;

a first insulating block and a second insulating block of primary thermal insulation barrier which are fixed to the first and second panels, respectively, and which rest against the corner arrangement of the secondary sealing membrane; and a corner of a primary sealing barrier comprising a first wing and a second wing which are fixed to the first and second insulating blocks, respectively; wherein:

the first and second panels each comprise a metal plate which is fixed to the internal face thereof and which carries a fixing member for an insulating block; and the corner arrangement of the secondary sealing membrane is of metal, has openings for the introduction of the fixing members of the insulating blocks and is welded, at the periphery of the openings, to the metal plates which carry the fixing members so as to ensure the sealing of the secondary sealing membrane.

Therefore, such a corner structure does not require any adhesive bonding operation for the insulating blocks of the primary thermal insulation membrane. In this manner, the fixing of insulating blocks to the corner structure can be carried out more easily in situ.

Furthermore, the mechanical securing of the insulating blocks to the corner structure ensures greater mechanical strength than securing by adhesive bonding.

According to embodiments, such a tank may comprise one or more of the following features: the fixing members of the insulating blocks are threaded pins which cooperate with nuts, the insulating blocks each comprising an opening for the introduction of a pin and a recess which communicates with the opening for the introduction of a pin and which has an abutment surface for a nut bounding the opening for the introduction of a pin; the first and second insulating blocks comprise a lateral edge adjacent to the tank corner, a lateral edge opposite the tank corner, and an internal face which cooperates with the corner of a primary sealing barrier and in which the recesses open at the lateral edge opposite the tank corner and/or in an internal face portion which is contiguous with the lateral edge opposite the tank corner and which is not covered by the corner of a primary sealing barrier; the corner structure comprises insulating elements for closing the recesses; the recesses are formed by indentations comprising a base which forms the abutment surface of a nut and which opens at a portion of the internal face of the insulating blocks extending, in the direction toward the lateral edge opposite the tank corner of the insulating blocks, beyond an edge of the corner of a primary sealing barrier; the corner has edges which are provided with cut-outs which are arranged opposite the indentations which open at the internal face of the first and second insulating blocks; the recess is formed by a recess of the lateral edge opposite the tank corner, providing a lug which carries the abutment surface of a nut; the corner arrangement of the secondary sealing membrane comprises a first metal sheet which is fixed to the first panel, a second metal sheet which is fixed to the second panel and a metal corner which is welded to the first and second metal sheets; the wings of the corner of a primary sealing barrier each comprise an external face which is provided with a pin, projecting outward, for fixing the corner to the first and second insulating blocks; the corner structure comprises a plurality of first and second insulating blocks which are distributed over the first and second panels, respectively, and a plurality of corners of a primary sealing barrier which are each fixed to a first insulating block and a second insulating block; the tank comprises a planar wall, at the end of which the corner structure is arranged, the secondary sealing membrane of the planar wall being welded to the corner arrangement of the secondary sealing membrane and the primary sealing membrane of the planar wall being welded to a wing of the corner of a primary sealing barrier; the secondary sealing membrane of the planar wall comprises a plurality of metal plates comprising undulations extending in two perpendicular directions; the secondary thermal insulation barrier of the planar wall comprises a plurality of heat-insulating panels, between which gaps are provided, the undulations of the metal plates of the secondary sealing membrane projecting toward the outer side of the tank and being inserted in the gaps.

Such a tank may be part of a ground-based storage installation, for example, in order to store LNG or to be installed in a floating structure, at the coast or in deep water, in particular a methane tanker, a floating storage and regasification unit (FSRU), an offshore floating production and storage unit (FPSO) and the like.

According to an embodiment, the disclosure relates to an assembly method for a corner structure as mentioned above, comprising: the assembly of a plurality of preassembled modules each comprising a corner of a primary sealing barrier and a first insulating block and a second insulating block, the assembly step comprising, for each preassembled module, the fixing of a corner of a primary sealing barrier to a first insulating block and a second insulating block; and the fixing of the plurality of preassembled modules to the first and second panels forming a corner of the secondary thermal insulation membrane.

According to an embodiment, a first plurality of preassembled modules are fixed to the first and second panels in the workshop and a second plurality of preassembled modules are fixed to the first and second panels in situ in the tank. Thus, the transport and handling of the corner structure are made easier.

According to an embodiment, a tanker for transporting a fluid comprises a double hull and an above-mentioned tank, in which the double hull forms the external carrier structure of the tank.

According to an embodiment, the disclosure also provides for a method for loading or unloading such a tanker, wherein a fluid is conveyed through the insulated channels from or toward a floating or ground-based storage installation toward or from the tank of the tanker.

According to an embodiment, the disclosure also provides for a transfer system for a fluid, the system comprising the above-mentioned tanker, insulated channels which are arranged so as to connect the tank which is installed in the hull of the tanker to a floating or ground-based storage installation and a pump for driving a flow of fluid through the insulated channels from or toward the floating or ground-based storage installation toward or from the tank of the tanker.

BRIEF DESCRIPTION OF THE DRAWINGS

The disclosure will be better understood and other objectives, details, features and advantages thereof will be appreciated more clearly from the following description of several specific embodiments of the disclosure, given purely by way of non-limiting illustration, with reference to the appended drawings, in which.

DETAILED DESCRIPTION

In conventional manner, the terms "external" and "internal" are used to define the relative position of one element in relation to another, with reference to the inner side and outer side of the tank.

The sealed and thermally insulating tank comprises, from the outer side toward the inner side of the tank, a carrier structure, a secondary thermally insulating barrier, a secondary sealing membrane, a primary thermally insulating barrier and a primary sealing membrane which is intended to be in contact with the cryogenic fluid contained in the tank.

The carrier structure may particularly be a self-supporting metal sheet or, more generally, any type of rigid partition which has suitable mechanical properties. The carrier structure may in particular be formed by the hull or the double hull of a tanker. The carrier structure comprises a plurality of walls defining the general form of the tank.

Figure 1:
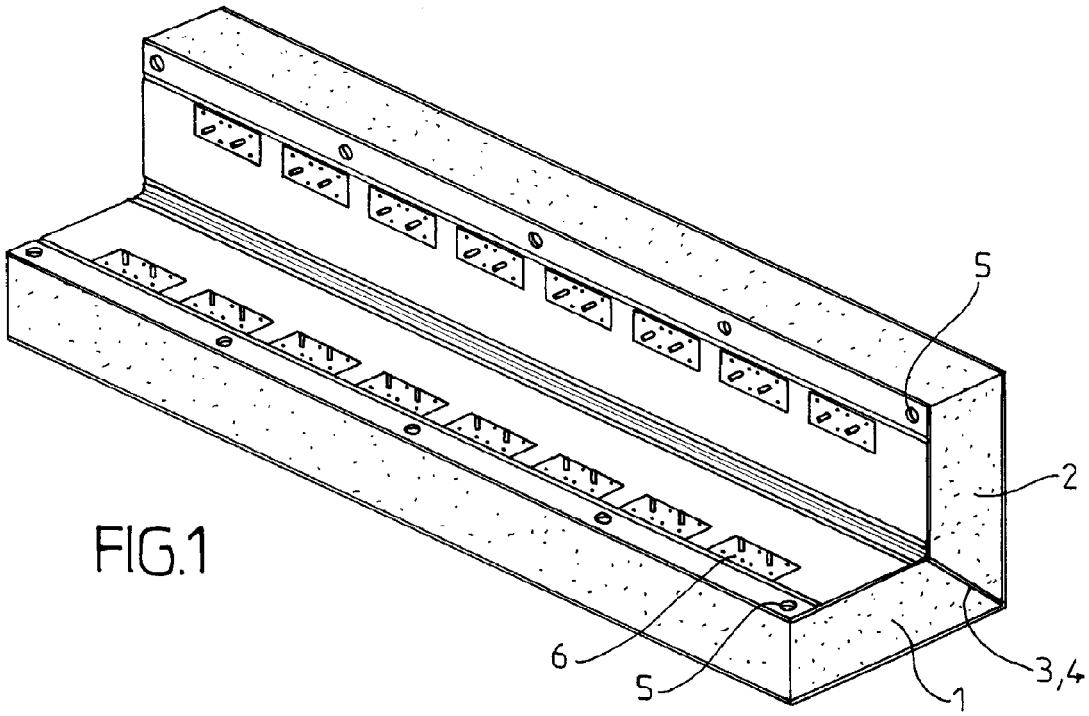
FIGS. 1, 3, 5, 7 and 9 are perspective views illustrating the successive assembly steps for a corner structure of a sealed and thermally insulating tank.
Figure 2:
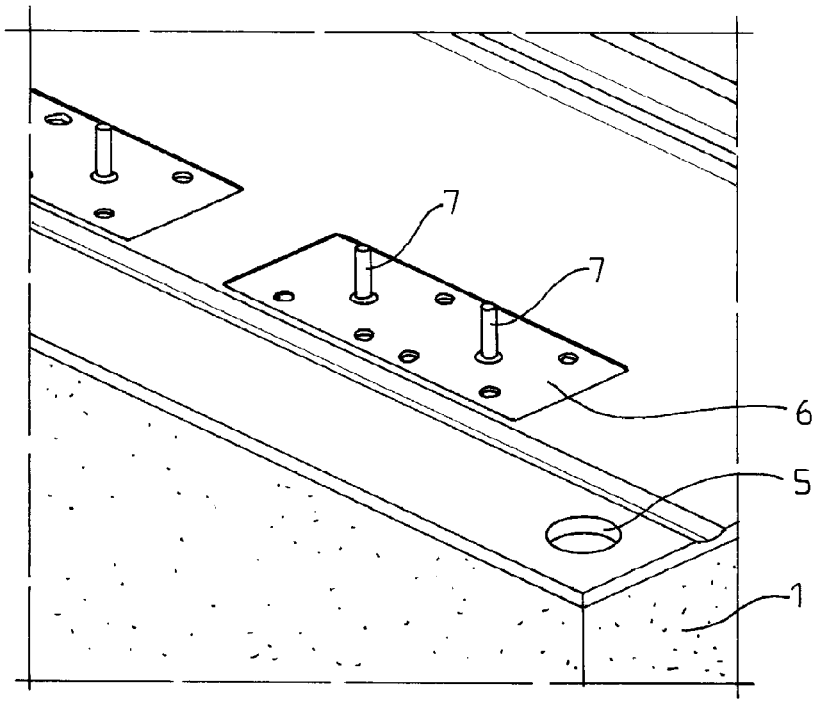
FIG. 2 is a detailed view of FIG. 1, illustrating a metal plate, which is fixed to the internal face of one of the panels which forms the corner of the secondary thermal insulation barrier and which carries fixing pins for insulating blocks of the primary thermal insulation barrier.
Figure 3:
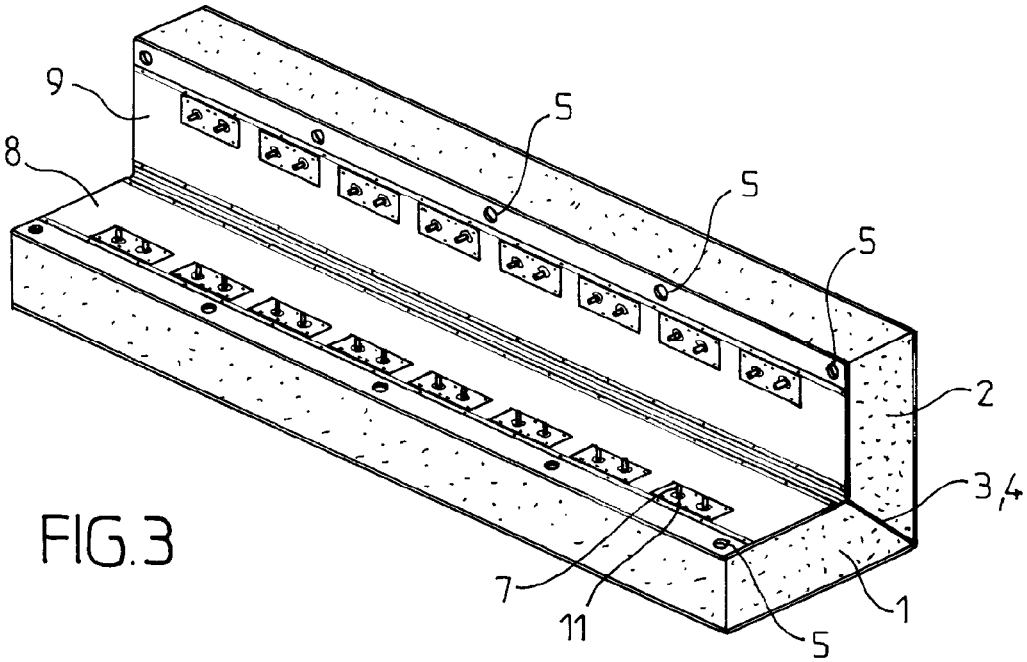
Figure 4:
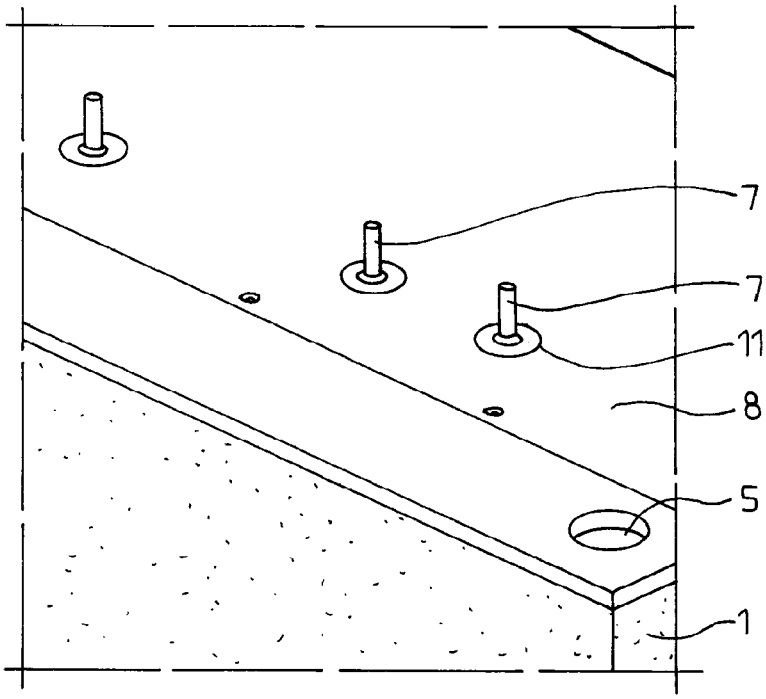
FIG. 4 is a detailed view of FIG. 3, illustrating the introduction of pins for fixing insulating blocks of the primary thermal insulation barrier, through a metal sheet of the secondary sealing membrane.

FIG. 1 illustrates the secondary thermal insulation barrier, having a corner structure which is intended to be arranged at the intersection between two walls of the carrier structure. The secondary thermal insulation barrier comprises two heat-insulating panels 1, 2. The panels 1, 2 have an external face which is intended to be fixed against the walls of the carrier structure. The panels 1, 2 further have a cross-section in the form of a rectangular trapezium and are connected to each other, for example, by adhesive bonding, via the chamfered lateral edge 3, 4 thereof. The panels 1, 2 thereby form a corner of the secondary thermal insulation barrier.

In the embodiment illustrated, the heat-insulating panels 1, 2 comprise a layer of insulating polymer foam which is engaged in a sandwich between two internal and external rigid plates, which are adhesively bonded to the foam layer. The internal and external rigid plates are, for example, of plywood. The polymer foam may in particular be a high-density polyurethane foam, which may optionally be reinforced with glass fibers.

The panels 1, 2 have cylindrical indentations 5 which open at the internal face thereof and which are intended to receive the end of a threaded pin, which is welded to the carrier structure, in order to ensure securing of the panels 1, 2. The cylindrical indentations 5 communicate with openings for the introduction of the pins (not illustrated) which open at the external face of the panels 1, 2. The cylindrical indentations 5 have a diameter greater than that of the openings for the introduction of the pins so that the bases of the cylindrical indentations 5 define an abutment surface which is intended to cooperate with a nut which is screwed to the threaded pin. When the fixing of the panels 1, 2 to the carrier structure have been carried out, plugs of an insulating material (not illustrated) can be introduced into the cylindrical indentations 5 so as to ensure continuity of the secondary thermal insulation barrier.

In addition to the securing of the panels 1, 2 by pins which are welded to the carrier structure, beads of polymerizable resin may be arranged between the carrier structure and the external face of the panels 1, 2.

The panels 1, 2 are provided with a plurality of metal plates 6, which are fixed to the internal rigid plate thereof by screws, rivets or staples, for example. The metal plates 6 carry threaded pins 7 which project toward the inner side of the tank, and which are intended to ensure the fixing of the primary thermal insulation barrier to the panels 1, 2.

FIGS. 3 to 6 illustrate the corner arrangement of the secondary sealing membrane. The corner arrangement comprises two metal sheets 8, 9 which are each fixed to a panel 1, 2 by screws, rivets or staples, for example. The metal sheets 8, 9 are provided with openings 11 for the introduction of the pins 7. In order to ensure the sealing of the secondary sealing membrane, the metal sheets 8, 9 are welded, at the periphery of the openings 11, to the metal plates 6.

In an embodiment, the welding of the metal sheets 8, 9 to the plates 6 is carried out by an orbital welding process. The orbital welding equipment is advantageously capable of being secured to the pins 7 in such a manner that the welding can be carried out in an automated manner.

Figure 5:
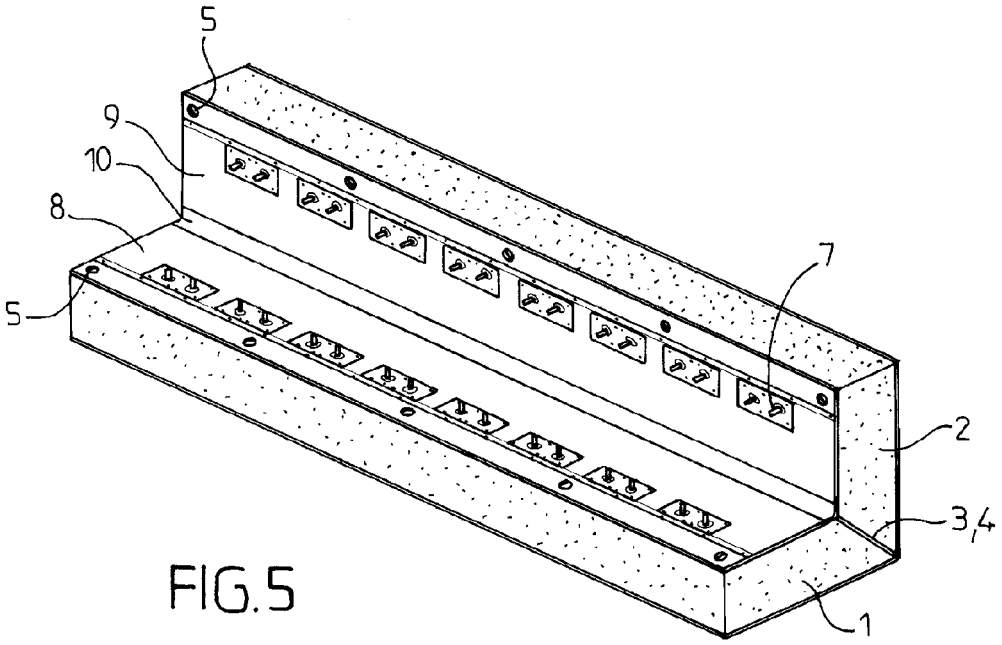
Figure 6:
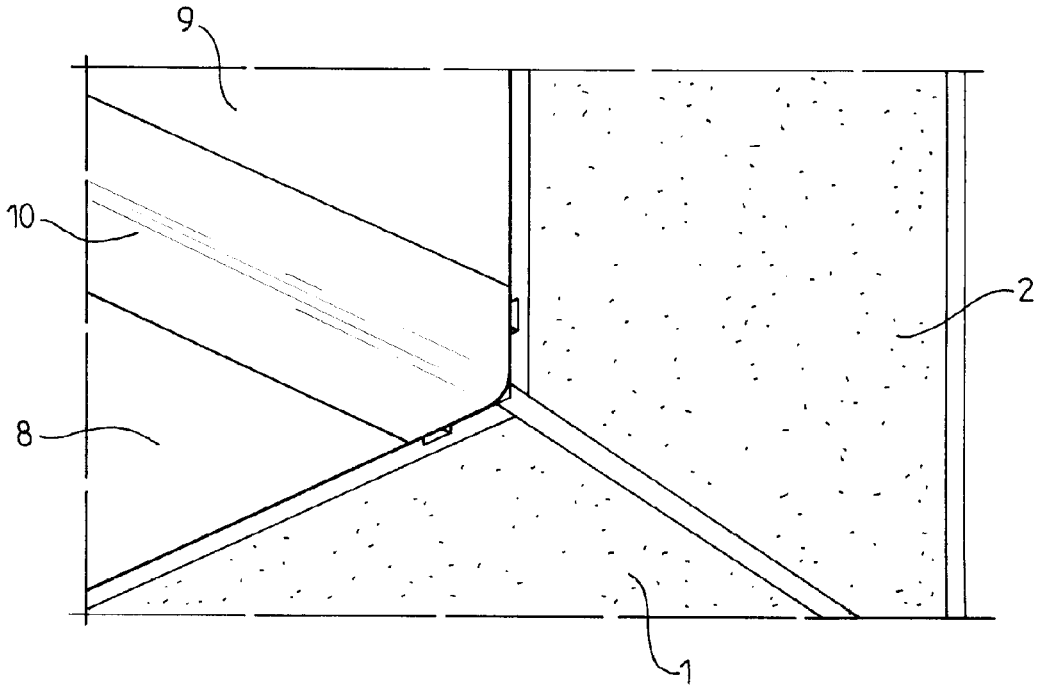
FIG. 6 is a detailed view of FIG. 5, illustrating a corner arrangement of the secondary sealing membrane.

The corner arrangement of the secondary sealing membrane also comprises a metal corner 10 which is illustrated in FIGS. 5 and 6. The metal corner 10 is lap-welded to the metal sheets 8, 9 so as to ensure the sealing of the secondary sealing membrane in the corner zone. The welding of the metal corner 10 to the metal plates 8, 9 is brought about by a piece of continuous welding equipment. Such welding equipment is advantageously capable of being secured to the pins 7.

In the embodiment illustrated, the openings 11 for the introduction of the pins 7 are bores which are provided in the metal sheets 8, 9. However, it may be envisaged to produce the openings for the introduction of the pins by any other means. In particular, such openings may be formed by means of cut-outs which are formed in an edge of the corner and/or in the edge of the metal sheets adjacent to the corner. In this manner, it is not necessary to perforate the corner 10 or the metal sheets 8, 9 in order to allow the pins 7 to pass. In a similar manner, it is also possible to provide for a plurality of metal sheets which rest on each of the panels 1 and 2 and to form cut-outs in the adjacent edges of the metal sheets so as to form the introduction openings for the pins 7.

Figure 7:
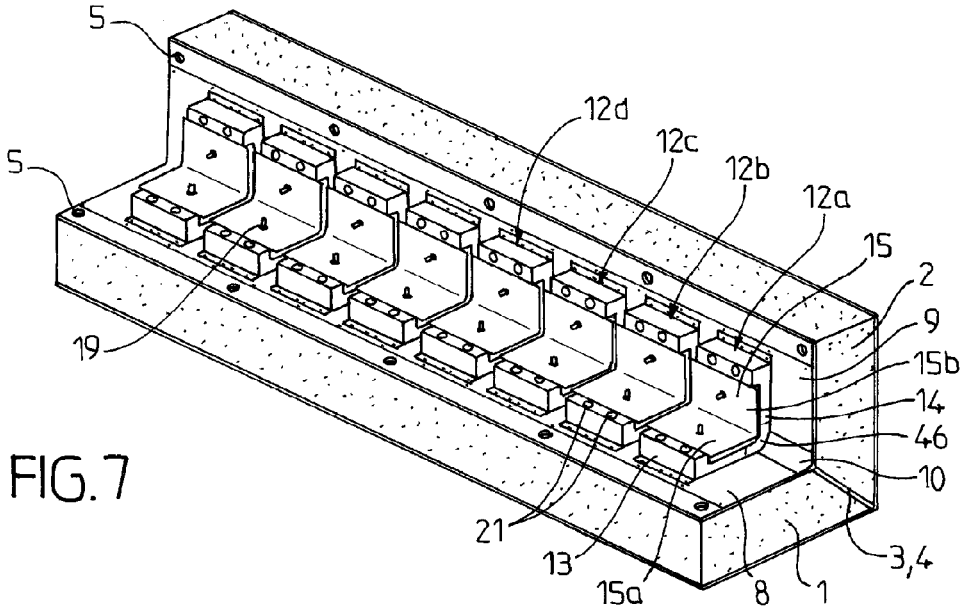
Figure 8:
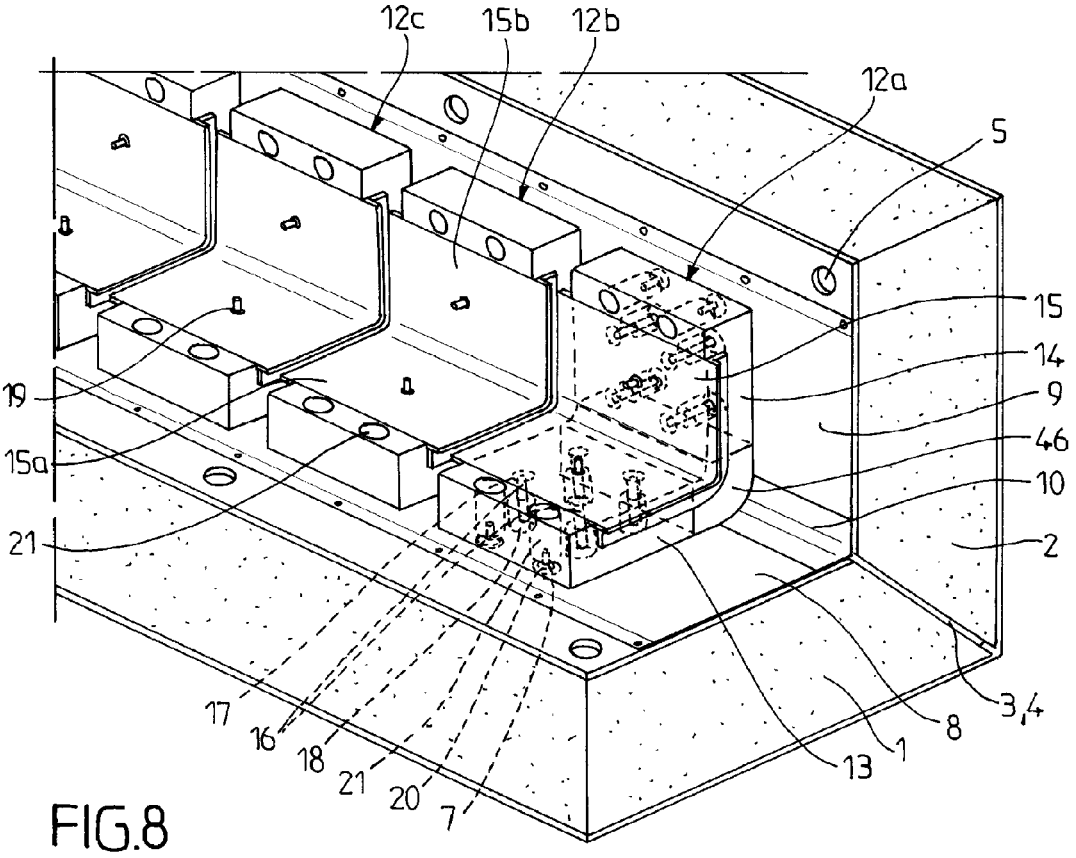
FIG. 8 is a detailed view of FIG. 7, in which, for a better understanding, two insulating blocks and a corner of the primary sealing membrane are illustrated in a transparent manner so as to visualize the fixing members of the corner with respect to the insulating blocks and the fixing members of the insulating blocks with respect to the secondary thermal insulation barrier.

Subsequently, as illustrated in FIGS. 7 and 8, insulating blocks 13, 14 of the primary thermal insulation barrier and metal corners 15 of the primary sealing barrier are fixed to the panels 1, 2.

In an advantageous embodiment, the insulating blocks 13, 14 and the metal corners 15 are assembled beforehand in the form of modules 12*a*, 12*b*, 12*c*, 12*d*. Each preassembled module 12*a*, 12*b*, 12*c*, 12*d* comprises two insulating blocks 13, 14 of a primary thermal insulation barrier and a corner 15 which is fixed to the two insulating blocks 13, 14.

The insulating blocks 13, 14 are of generally rectangular parallelepiped form. They comprise an internal face on which the corner 15 rests and an external face which rests against one of the metal sheets 8, 9. The insulating blocks 13 and 14 are fixed to the panels 1 and 2, respectively. The insulating blocks 13, 14 may be integrally produced from plywood or have a composite structure similar to that of the panels 1, 2, that is to say, comprising a layer of insulating polymer foam engaged in a sandwich-like manner between two internal and external rigid plates which are adhesively bonded to the layer of foam.

The corners 15 are metal corners, for example, produced from stainless steel. The corners 15 have two wings 15*a* and 15*b*, which are perpendicular in the embodiment illustrated, resting against the internal face of the insulating blocks 13 and 14. The wings 15*a*, 15*b* have pins 16 which are for fixing to the insulating blocks 13, 14, are illustrated in FIG. 8, welded to the external face of the wings 15*a*, 15*b* and project toward the inner side of the tank. The insulating blocks comprise openings 17 which are for the introduction of the pins 16 and which are formed at the internal face thereof. The openings 17 for the introduction of the pins communicate with cylindrical indentations 18 which open at the external face of the insulating blocks 13, 14. Nuts which are screwed to the pins 16 press against the base of the cylindrical indentations 18 and thus bring about the connection of the corner 15 to the insulating blocks 13, 14. In the FIGS. 7 to 12, the wings 15*a*, 15*b* also have pins 19 which are welded to the internal face thereof. Such pins 19 allow a piece of welding equipment to be secured during the welding of the primary sealing membrane elements to the corners 15.

Furthermore, a corner connector 46 of insulating material, such as a polymer foam, is arranged between the adjacent edges at the tank corner of two insulating blocks 13, 14 and thereby ensures continuity of the thermal insulation in the region of the corner of the tank.

In order to ensure the fixing of the insulating blocks to the pins 7 which are carried by the panels 1, 2, the insulating blocks 13, 14 are provided with openings 20 for the introduction of the pins 7, which openings are provided in the internal face thereof. In the embodiment illustrated in FIGS. 7 to 10, the openings 20 for the introduction of the pins 7 communicate with cylindrical indentations 21 which open at the internal face of the insulating blocks 13, 14. The bases of the cylindrical indentations 21 define abutment surfaces for nuts which cooperate with the threaded ends of the pins 7.

In order to ensure the fixing of the insulating blocks 13, 14 to the pins 7, whilst corners 15 have been fixed beforehand to the insulating blocks 13, 14, the cylindrical indentations 21 open in portions of the internal face of the insulating blocks 13, 14, which portions are not covered by the corners 15. To this end, in the embodiment illustrated in FIGS. 7 to 10, the insulating blocks 13, 14 project, in the opposite direction to the tank corner, beyond the edges of the corners 15. Furthermore, the cylindrical indentations 21 are provided in the portions of the insulating blocks 13, 14 projecting beyond the edge of the corners 15. Thus, it is possible to gain access to the cylindrical indentations 21 in order to ensure the fixing of the insulating blocks 13, 14 to the pins 7 while the corner 15 is positioned on the insulating blocks 13, 14.

Figure 9:
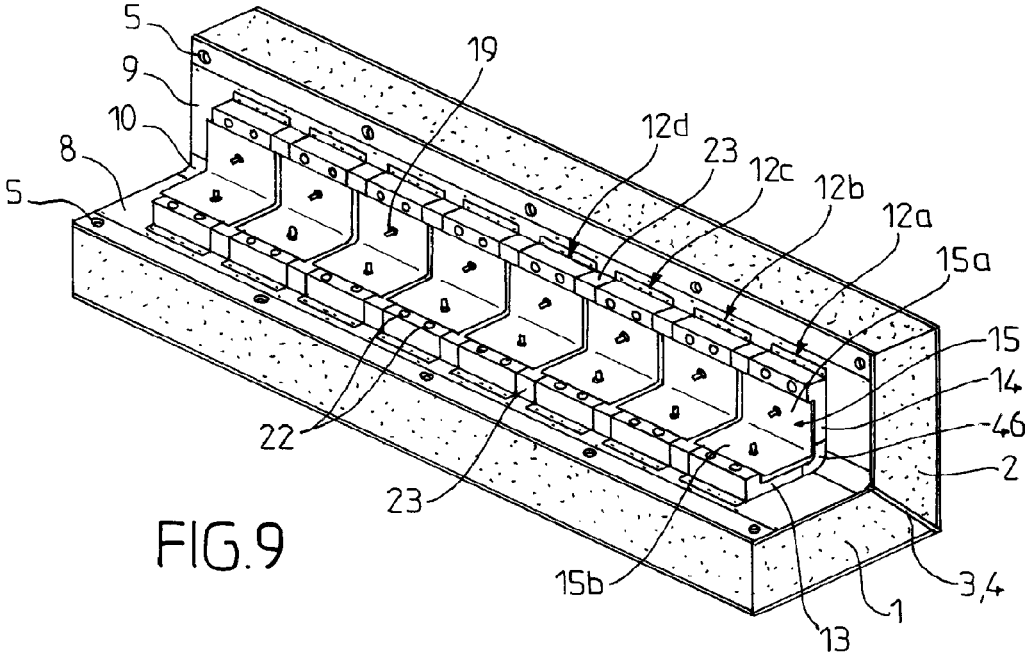
Figure 10:
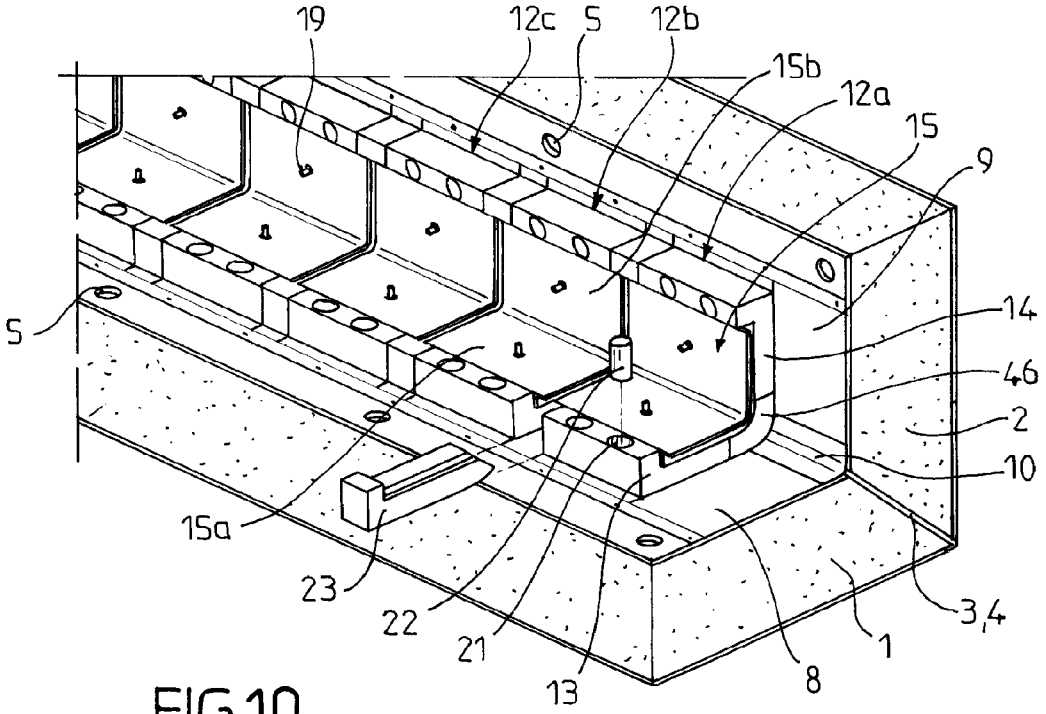
FIG. 10 is a detailed view of FIG. 9, more specifically illustrating insulating elements for filling a recess which is formed in an insulating block or a joint between two adjacent insulating blocks, before the positioning of the insulating elements.

When the insulating blocks 13, 14 have been secured to the pins 7, the cylindrical indentations 21 are closed by plugs 22 of insulating material, in particular illustrated in FIGS. 9 and 10. Furthermore, insulating joining elements 23 are inserted between the insulating blocks 13, 14.

The arrangement of the insulating blocks 13, 14 and the corners 15 in the form of preassembled modules 12*a*, 12*b*, 12*c*, 12*d* is particularly advantageous and allows different assembly and transport methods for the corner structures. In an embodiment, the panels 1, 2 of the corner structure are assembled, in situ, at the installation site of the tank by fixing a plurality of preassembled modules 12*a*, 12*b*, 12*c*, 12*d* to the panels 1, 2. In another embodiment, the panels 1, 2, the corner arrangement of the secondary sealing membrane and a portion or the whole of the preassembled modules 12*a*, 12*b*, 12*c*, 12*d* are assembled at the workshop. In an advantageous variant, there is provision for there to be fixed to the panels 1, 2 at the workshop only a number of preassembled modules 12*a*, 12*b*, 12*c*, 12*d* necessary for ensuring the mechanical strength of the corner structure during the transport and handling thereof, the remainder of the preassembled modules subsequently being fixed at the installation site of the tank. Such an assembly method limits the weight of the corner structure during the transport and handling thereof, without for all that impairing the ergonomics of the assembly in situ of the tank.

Figure 11:
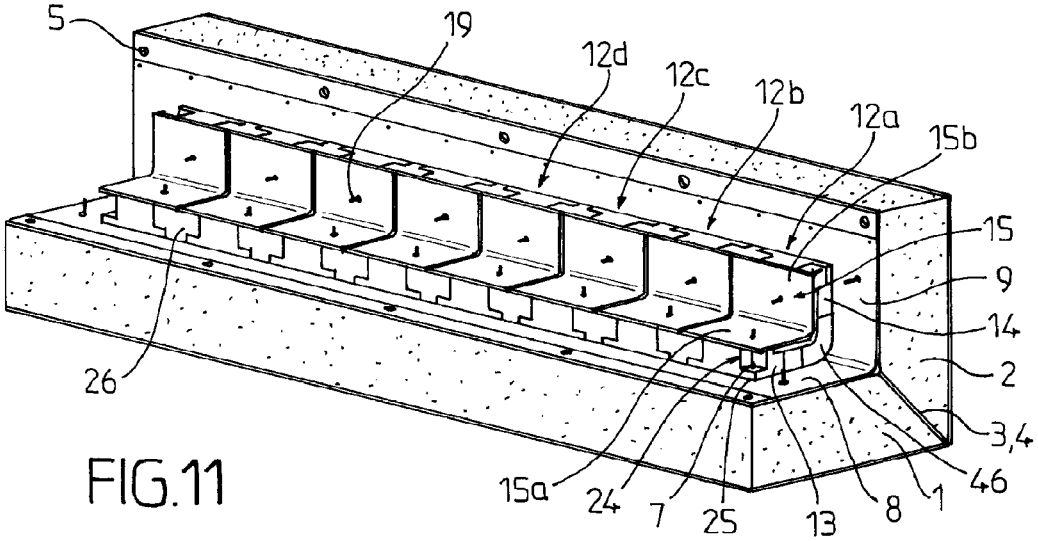
FIG. 11 is a perspective view of a corner structure according to a second embodiment.
Figure 12:
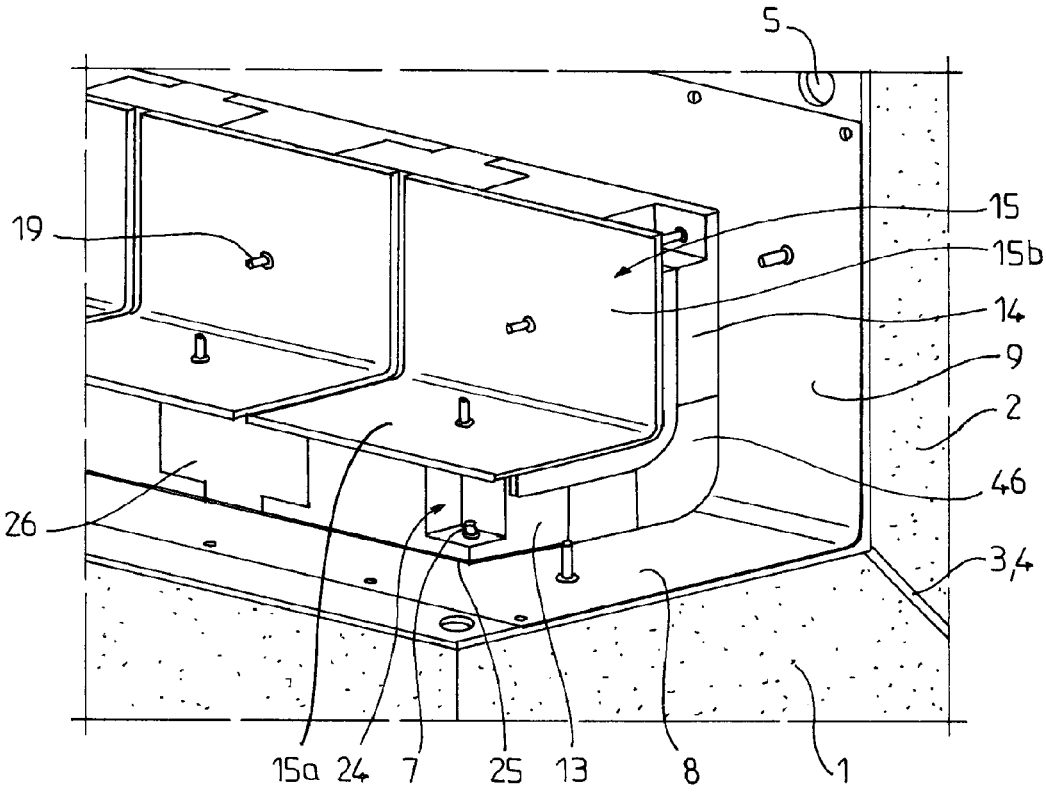
FIG. 12 is a detailed view of FIG. 11.

FIGS. 11 and 12 set out a corner structure according to another embodiment. The insulating blocks 13, 14 also have openings for the introduction of the pins provided in the internal face thereof. In this embodiment, however, the openings communicate with recesses 24, which are formed in the insulating blocks 13, 14 and which open at the lateral edge thereof opposite the tank corner. The recesses 24 are formed by recesses which are formed in the lateral edge opposite the tank corner. The recesses provide lugs 25 which carry the abutment surface of the nuts which cooperate with the threaded end of the pins 7. The recesses 24 are advantageously formed in the region of the corners of the insulating blocks 13, 14. In this manner, the recesses 24 open at the gap between two adjacent insulating blocks 13, 14 and the filling of a gap between two adjacent insulating blocks 13, 14 and two recesses 24 which bound the gap can be carried out by a single insulating joining element 26. It may be noted that such recesses 24 also allow fixing of the insulating blocks 13, 14 to the pins 7, when corners 15 have been fixed to the insulating blocks 13, 14 beforehand.

Figure 13:
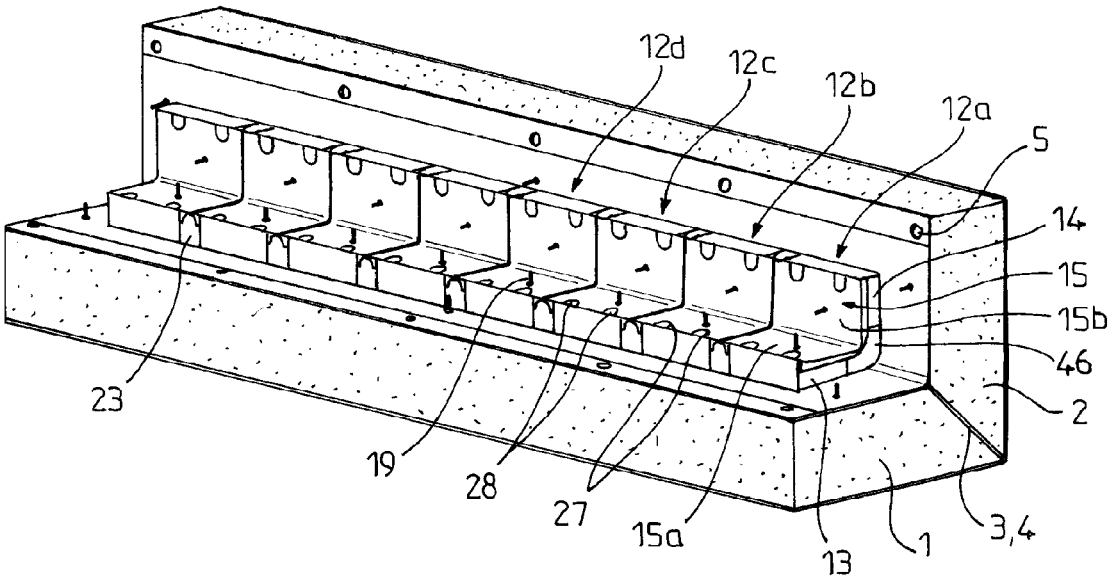
FIG. 13 is a perspective view of a corner structure according to a third embodiment.

FIG. 13 illustrates another embodiment. In this embodiment, the corners 15 have edges having cut-outs 27. The insulating blocks 13, 14 comprise cylindrical indentations 28 which communicate with introduction openings for the pins 7, which openings are provided at the external face of the insulating blocks 13, 14 and of which the base cooperates with a nut which is screwed onto a pin 7. The cylindrical indentations open at the internal face of the insulating blocks 13, 14 opposite the cut-outs 27 which are formed in the edges of the corners 15 in such a manner that the fixing of the insulating blocks 13, 14 to the pins 7 can be brought about in spite of the presence of the corner 15. The cylindrical indentations 28 are closed by plugs.

Figure 14:
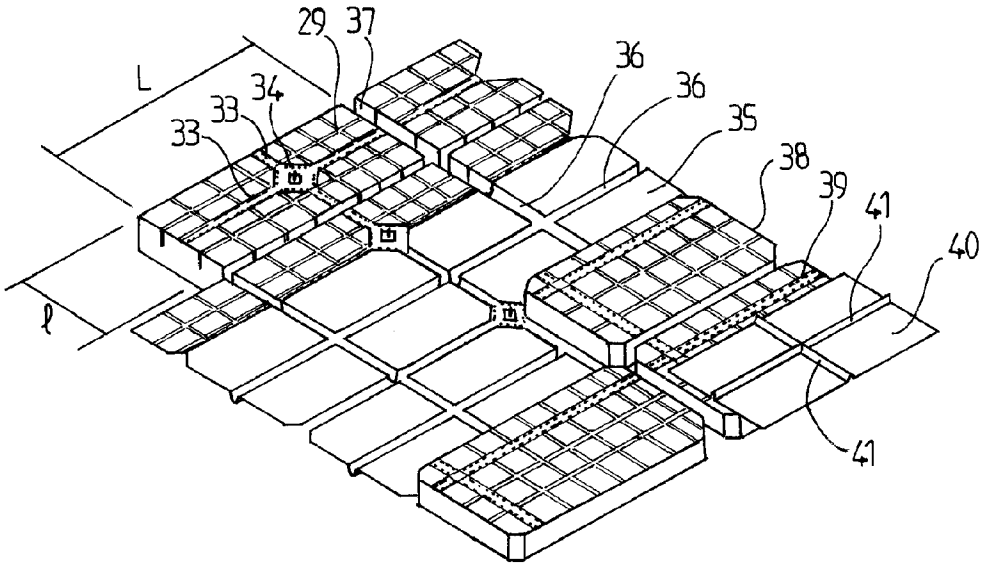
FIG. 14 is a perspective cut-away view of the elements of a wall of a sealed and thermally insulating tank.
Figure 15:
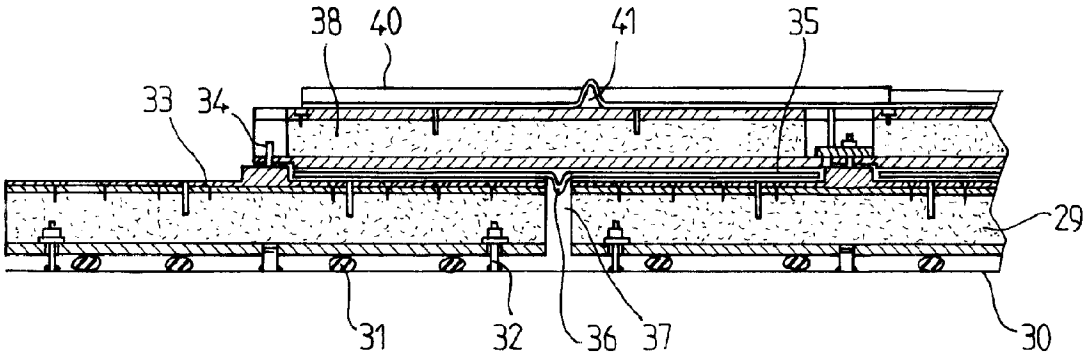
FIG. 15 is a cross-section of a wall of a sealed and thermally insulating tank.

FIGS. 14 and 15 illustrate, by way of example, the structure of the walls of a sealed and thermally insulating tank which is provided with a corner structure as described above.

The secondary thermal insulation barrier comprises a plurality of heat-insulating panels 29 which are secured to the carrier structure 30 by means of resin beads 31 and pins 32 which are welded to the carrier structure 1. The panels 29 are substantially in the form of a rectangular parallelepiped and have, in accordance with the two axes of symmetry thereof, a metal connection strip 33, which is positioned in a recess and which is fixed therein by screws, rivets, staples or adhesive. In the intersection zone of the metal connection strips, there is provided a pin 34 which projects toward the inner side of the tank and which allows the primary thermal insulation barrier to be fixed.

The secondary sealing membrane is obtained by assembling a plurality of metal plates 35 which are butt-welded and which have a substantially rectangular form. The metal plates 35 comprise, in accordance with each of the two axes of symmetry of this rectangle, an undulation 36 which forms a relief in the direction of the carrier structure 30. The metal plates 35 are in this instance arranged in an offset manner in relation to the panels 29 so that each of the metal plates 35 extends so as to straddle four adjacent panels 29. Furthermore, the undulations 36 are received in gaps 37 of the secondary thermal insulation barrier which are provided between two adjacent panels 29. The adjacent metal plates 35 are lap-welded to each other. The securing of the metal plates 35 to the panels 29 is brought about by means of the metal connection strips 33 to which at least two edges of the metal plates 35 are welded.

In the region of the corner zone, the metal plates 35 of the secondary sealing barrier are lap-welded to the metal sheets 8, 9 of the corner arrangement of the secondary sealing membrane.

The primary thermal insulation barrier comprises a plurality of heat-insulating panels 38 which are of substantially rectangular parallelepiped form and which cover the secondary sealing membrane. The panels 38 of the primary thermal insulation barrier also comprise at the internal face thereof metal connection strips 39 which allow the primary sealing barrier to be secured by welding.

The primary sealing membrane is obtained by assembling a plurality of metal plates 40, which are welded to each other along the edges thereof. The metal plates 40 comprise undulations 41 which extend in two perpendicular directions. The undulations 41 of the primary sealing membrane project from the side of the internal face of the metal plates 40. The metal plates 40 are, for example, produced from sheet metal of stainless steel or aluminum, which is formed by bending or by stamping. The metal plates 40 are offset in relation to the panels 38, each of the metal plates 40 extending so as to straddle four adjacent panels 38.

In the region of the corner zone of the primary sealing membrane, the metal plates 40 are welded to the corners 15. Furthermore, corner components which are not illustrated are positioned in a straddling manner between two adjacent corners 35. Such corner components comprise in their central zone an undulation which extends in the continuation of an undulation of the metal plate 40 and are lap-welded to the metal sheets 40 which extend at one side and the other of the corner structure and to the two corners 35 which they straddle.

Figure 16:
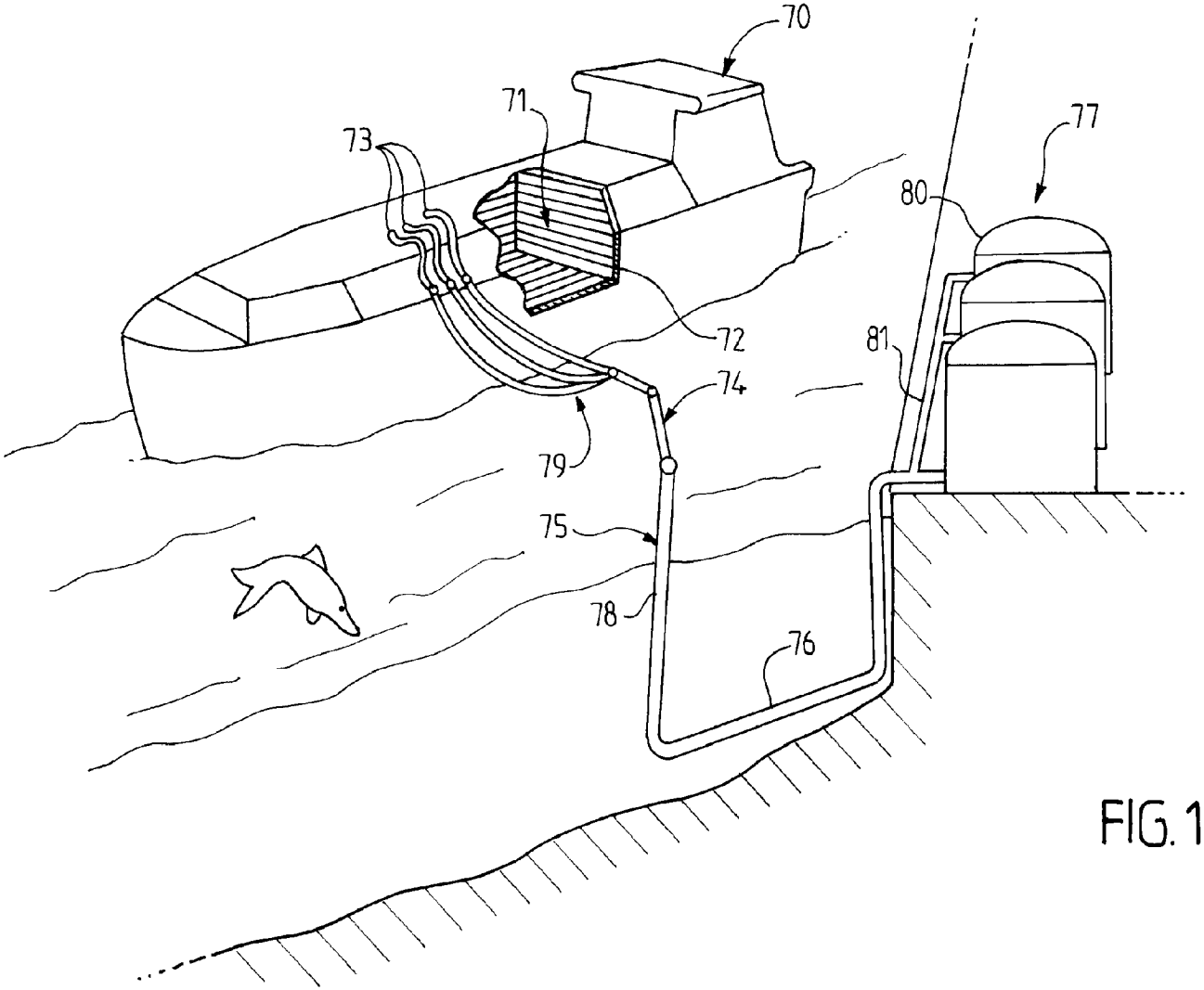
FIG. 16 is a cut-away schematic view of a tank of a methane tanker and a loading/unloading terminal of this tank.

With reference to FIG. 16, a cut-away view of a methane tanker 70 shows a sealed and insulated tank 71 which is of generally prismatic form and which is mounted in the double hull 72 of the tanker. The wall of the tank 71 comprises a primary sealed barrier which is intended to be in contact with the LNG which is contained in the tank, a secondary sealed barrier which is arranged between the primary sealed barrier and the double hull 72 of the tanker, and two insulating barriers which are arranged between the primary sealed barrier and the secondary sealed barrier and between the secondary sealed barrier and the double hull 72, respectively.

In a manner known per se, loading/unloading channels 73 which are arranged on the upper bridge of the tanker may be connected, by means of suitable connectors, to a sea-based or port-based terminal in order to transfer a cargo of LNG from or toward the tank 71.

FIG. 16 shows an example of a sea-based terminal which comprises a loading and unloading station 75, an underwater conduit 76 and a ground-based installation 77. The loading and unloading station 75 is a fixed off-shore installation comprising a movable arm 74 and a tower 78 which supports the movable arm 74. The movable arm 74 carries a bundle of flexible insulated pipes 79 which can be connected to the loading/unloading channels 73. The movable arm 74 which can be orientated is adapted to all the gauges of methane tankers. A connection conduit which is not illustrated extends inside the tower 78. The loading and unloading station 75 enables the loading and unloading of the methane tanker 70 from or to a ground-based installation 77. This comprises storage tanks 80 for liquefied gas and connection conduits 81 which are connected via the underwater conduit 76 to the loading or unloading station 75. The underwater conduit 76 enables liquefied gas to be transferred between the loading or unloading station 75 and the ground-based installation 77 over a great distance, for example, 5 km, which enables the methane tanker 70 to be kept at a great distance from the coast during the loading and unloading operations.

In order to produce the pressure required for the transfer of the liquefied gas, there are used pumps which are on-board the tanker 70 and/or pumps with which the ground-based installation 77 is provided, and/or pumps with which the loading and unloading station 75 is provided.

Although the disclosure has been described in connection with several specific embodiments, it is clearly evident that it is by no means limited thereto and that it comprises all the equivalent techniques of the means described and their combinations if they are included within the scope of the disclosure.

It should be noted in particular that, if the disclosure is described in relation to an embodiment in which the tank comprises two sealing and thermal insulation levels, it is in no way limited thereto and also applies to sealed tanks comprising only a single sealing and thermal insulation level.

The use of the verb "comprise", "contain" or "include" and the conjugated forms thereof does not exclude the presence of elements or steps other than those set out in a claim. The use of the indefinite article "a" or "an" for an element or a step, unless otherwise stated, does not exclude the presence of a plurality of such elements or steps.

In the claims, any reference numeral in brackets should not be interpreted to be a limitation of the claim.

The invention claimed is:

1. A sealed and thermally insulating tank for storing a fluid comprising a secondary thermal insulation barrier which is retained on a carrier structure, a secondary sealing membrane, a primary thermal insulation barrier and a primary sealing membrane which is intended to be in contact with the fluid contained in the tank, the tank including a corner structure comprising:

a first panel and a second panel forming a corner of the secondary thermal insulation barrier, and comprising an external face opposite the carrier structure and an internal face;

a corner arrangement of the secondary sealing membrane, which arrangement is fixed to the first and second panels;

a first insulating block and a second insulating block of a primary thermal insulation barrier which are fixed to the first and second panels, respectively, and which rest against the corner arrangement of the secondary sealing membrane; and a corner of a primary sealing barrier comprising a first wing and a second wing which are fixed to the first and second insulating blocks, respectively; wherein:

the first and second panels each comprise a metal plate which is fixed to the internal face thereof and which carries a fixing member for an insulating block; and the corner arrangement of the secondary sealing membrane is of metal, has openings for the introduction of the fixing members for the insulating blocks and is welded, at the periphery of the openings, to the metal plates which carry the fixing members so as to ensure the sealing of the secondary sealing membrane.

2. The tank as claimed in claim 1, wherein the fixing members of the insulating blocks are threaded pins which cooperate with nuts, the insulating blocks each comprising an opening for the introduction of a pin and a recess which communicates with the opening for the introduction of a pin and which has an abutment surface for a nut bounding the opening for the introduction of a pin.

3. The tank as claimed in claim 2, wherein the first and second insulating blocks comprise a lateral edge adjacent to the tank corner, a lateral edge opposite the tank corner, and an internal face which cooperates with the corner of a primary sealing barrier and wherein the recesses open at the lateral edge opposite the tank corner and/or in an internal face portion which is contiguous with the lateral edge opposite the tank corner and which is not covered by the corner of a primary sealing barrier.

4. The tank as claimed in claim 3, comprising insulating elements for closing the recesses.

5. The tank as claimed in claim 3, wherein the recesses are formed by indentations comprising a base which forms the abutment surface of a nut and which opens at a portion of the internal face of the insulating blocks extending, in the direction toward the lateral edge opposite the tank corner of the insulating blocks, beyond an edge of the corner of a primary sealing barrier.

6. The tank as claimed in claim 5, wherein the corner has edges which are provided with cut-outs which are arranged opposite the indentations which open at the internal face of the first and second insulating blocks.

7. The tank as claimed in claim 3, wherein the recess is formed by a recess of the lateral edge opposite the tank corner, providing a lug which carries the abutment surface of a nut.

8. The tank as claimed in claim 1, wherein the corner arrangement of the secondary sealing membrane comprises a first metal sheet which is fixed to the first panel, a second metal sheet which is fixed to the second panel and a metal corner which is welded to the first and second metal sheets.

9. The tank as claimed in claim 1, wherein the wings of the corner of a primary sealing barrier each comprise an external face which is provided with a pin, projecting outward, for fixing the corner to the first and second insulating blocks.

10. The tank as claimed in claim 1, wherein the corner structure comprises a plurality of first and second insulating blocks which are distributed over the first and second panels, respectively, and a plurality of corners of a primary sealing barrier which are each fixed to a first insulating block and a second insulating block.

11. An assembly method for a tank as claimed in claim 10, comprising:

the assembly of a plurality of preassembled modules each comprising a corner of a primary sealing barrier and a first insulating block and a second insulating block, the assembly step comprising, for each preassembled module, the fixing of a corner of a primary sealing barrier to a first insulating block and a second insulating block; and the fixing of the plurality of preassembled modules to the first and second panels forming a corner of the secondary thermal insulation membrane.

12. The assembly method as claimed in claim 11, wherein a first plurality of preassembled modules are fixed to the first and second panels in the workshop and a second plurality of preassembled modules are fixed to the first and second panels in situ in the tank.

13. The tank as claimed in claim 1, comprising a planar wall, at one end of which the corner structure is arranged, the secondary sealing membrane of the planar wall being welded to the corner arrangement of the secondary sealing membrane and the primary sealing membrane of the planar wall being welded to a wing of the corner of a primary sealing barrier.

14. The tank as claimed in claim 13, wherein the secondary sealing membrane of the planar wall comprises a plurality of metal plates comprising undulations extending in two perpendicular directions.

15. The tank as claimed in claim 14, wherein the secondary thermal insulation barrier of the planar wall comprises a plurality of heat-insulating panels, between which gaps are provided, and wherein the undulations of the metal plates of the secondary sealing membrane project toward the outer side of the tank and are inserted in the gaps.

16. A tanker for transporting a fluid, the tanker comprising a double hull and a tank as claimed in claim 1, wherein the double hull forms the external carrier structure of the tank.

17. A method for loading or unloading a tanker as claimed in claim 16, wherein a fluid is conveyed through insulated channels from or toward a floating or ground-based storage installation toward or from the tank of the tanker.

18. A transfer system for a fluid, the system comprising a tanker as claimed in claim 16, insulated channels which are arranged so as to connect the tank which is installed in the hull of the tanker to a floating or ground-based storage installation and a pump for driving a flow of fluid through the insulated channels from or toward the floating or ground-based storage installation toward or from the tank of the tanker.

* * * * *